US007736325B2

(12) United States Patent
Tung et al.

(10) Patent No.: US 7,736,325 B2
(45) Date of Patent: Jun. 15, 2010

(54) AUTOMATIC BACK PATTER

(76) Inventors: Wei-Chih Tung, 5F.-2, No. 8, Lane 62, Singuang Rd., Lingya District, Kaohsiung City (TW); Ming-Lang Lee, 12F.-1, No. 45, Pingdeng Rd., Sanmin District, Kaohsiung City (TW)

( * ) Notice: Subject to any disclaimer, the term of this patent is extended or adjusted under 35 U.S.C. 154(b) by 819 days.

(21) Appl. No.: 11/654,535

(22) Filed: Jan. 18, 2007

(65) Prior Publication Data

US 2008/0177206 A1 Jul. 24, 2008

(51) Int. Cl.
*A61H 23/00* (2006.01)

(52) U.S. Cl. ..... 601/108; 601/101; 601/111

(58) Field of Classification Search ..... 601/89, 601/90, 93, 97, 98, 101, 103, 107, 108, 110, 601/111, 112

See application file for complete search history.

(56) References Cited

U.S. PATENT DOCUMENTS 3,881,470 A * 5/1975 Glore ..... 601/111
4,608,967 A * 9/1986 Piro ..... 601/107
5,159,922 A * 11/1992 Mabuchi et al. ..... 601/110

* cited by examiner

*Primary Examiner*—Quang D Thanh
(74) *Attorney, Agent, or Firm*—Rosenberg, Klein & Lee

(57) ABSTRACT

An automatic back patter includes a main body, a power source, a striking disc, at least one transmitting arm, and at least patter head. The power source, the striking disc, and the transmitting arm (or arms) are installed in the main body, with the transmitting arm connected to the striking disc at one end and connected to the patter head at the other end. The patter head is fitted in an opening provided in an upper wall of the main body. Then when the power source is started, the patter head is moved up and down by the transmitting arm that is moved up and down by rotation of the striking disc rotated by the power source. When the patting head is moved up and down, it protrudes out of the opening of the main body to pat continuously and regularly the body surface of a user, whose blood circulation may be invigorated, preventing the user from getting bedsores.

18 Claims, 9 Drawing Sheets

AUTOMATIC BACK PATTER

BACKGROUND OF THE INVENTION

1. Field of the Invention

This invention relates to an automatic back patter, particularly to one usable for a patient bedridden for a long period of time in order to invigorate blood circulation and to prevent the muscle tissue from gradually dying.

2. Description of the Prior Art

A patient lying in bed for long and hardly possible to turn over his/her body, for example, those suffering stroke, vegetables, those with four limbs paralyzed, and seniors bedridden. Such a person is apt to suffer from bad partial blood circulation in the body surface, and if worse, his/her muscle tissue may die, so to speak, getting "bedsores", which often happen to the portions of the body where receives heavy weight, such as the back and the buttocks. In order to avoid such bedsores, those sections of the body have to be regularly patted or massaged and the body has to be often turned over, as shown in FIG. 9. However, such long regular works may be a troublesome, laborious and tiresome task for the family members of a patient, and if a professional nurse is hired for that purpose, the expense may be a large economic burden to a family. Even if a special nurse is hired for a patient, if the nurse has to take care of a few patients at the same time, the nurse may not be able to regularly turn the body of the patient or make patting or massaging at regular time, so the bedsores may not be surely prevented from happening.

3. Description of the Prior Art

There are many kinds of massaging machine and devices, but they are hardly applicable to a patent bed-ridden for a long period of time and difficult to turn over the body.

In view of lessening pains and troubles of a bed-ridden patient and burdens of his/her family and a nurse taking care of the patient, this invention has been devised to offer an automatic back patter that can make regular patting on the back of a patient or any other section of the body. Then the muscle of the back can be massaged to stimulate blood circulation for preventing the muscle tissues from getting dead.

SUMMARY OF THE INVENTION

This invention has been devised to offer an automatic back patter, which has a main body, a power source, a striking disc, a plurality of transmitting arms, and a plurality of patting heads. The power source, the striking disc and the transmitting arms are installed in the main body, which has an upper wall bored with plural openings for the patting heads to be movably fitted therein. The striking disc is provided with a plurality of inclined projections arranged around a circumference of an upper surface, with one end of the transmitting arms contacting the upper surface, and with the other end connected to each patter head. When the automatic back patter is bound on the back of a patient and the power source is started, the striking disc is rotated to move the transmitting arms up and down alternately, and then forcing the patting heads to move up and down in the openings of the main body so that the patting heads can protrude out of the opening to pat regularly on the body surface of the patient. Therefore, the patient bedridden for long can be massaged, with the blood circulation stimulated, and with bedsores possible to be prevented from happening.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
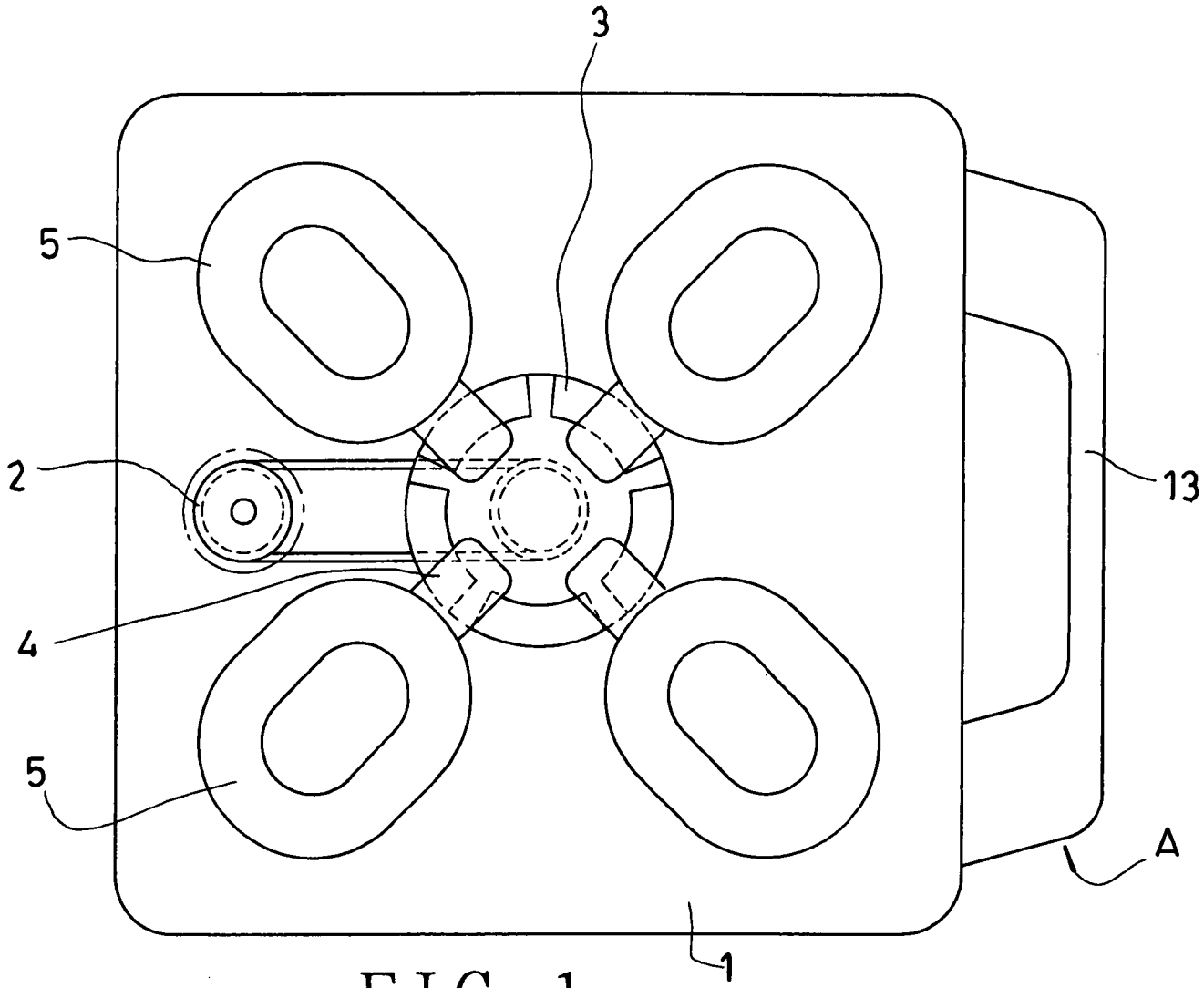
FIG. 1 is an upper view of a first embodiment of an automatic back patter in the present invention.
Figure 2:
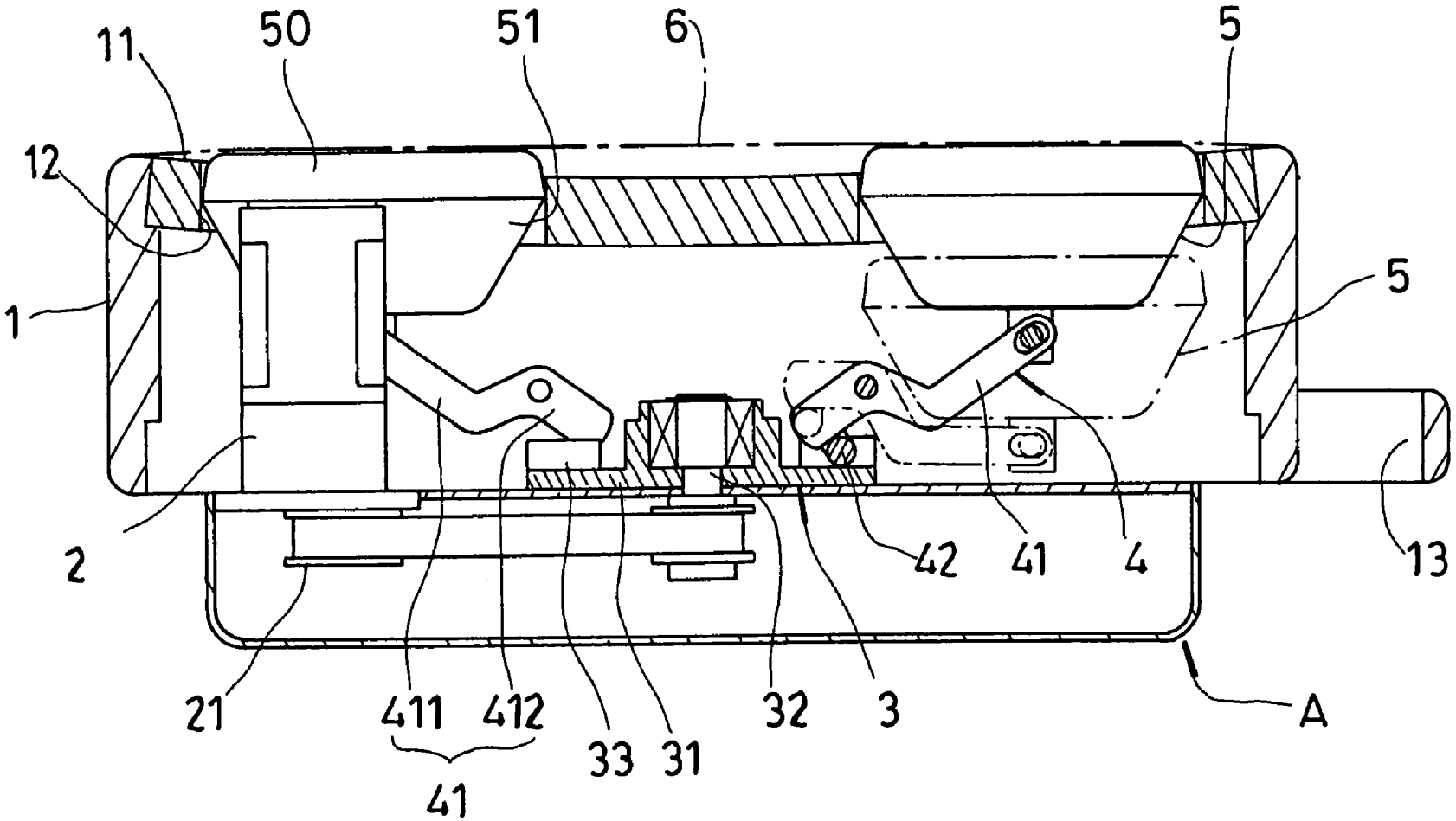
FIG. 2 is a side cross-sectional view of the first embodiment of an automatic back patter in the present invention.

A first embodiment of an automatic back patter (A) in the present invention, as shown in FIGS. 1 and 2, includes a main body 1, a power source 2 fixed in the main body 1, a striking disc 3 connected to the power source 2, a plurality of transmitting arms 4 mounted on the striking disc 3, a plurality of patting heads 5 respectively connected to the transmitting arms 4 and possible to protrude out of the main body 1, and a film 6 adhered on an upper surface of the patting head 5 as main components combined together.

Figure 5:
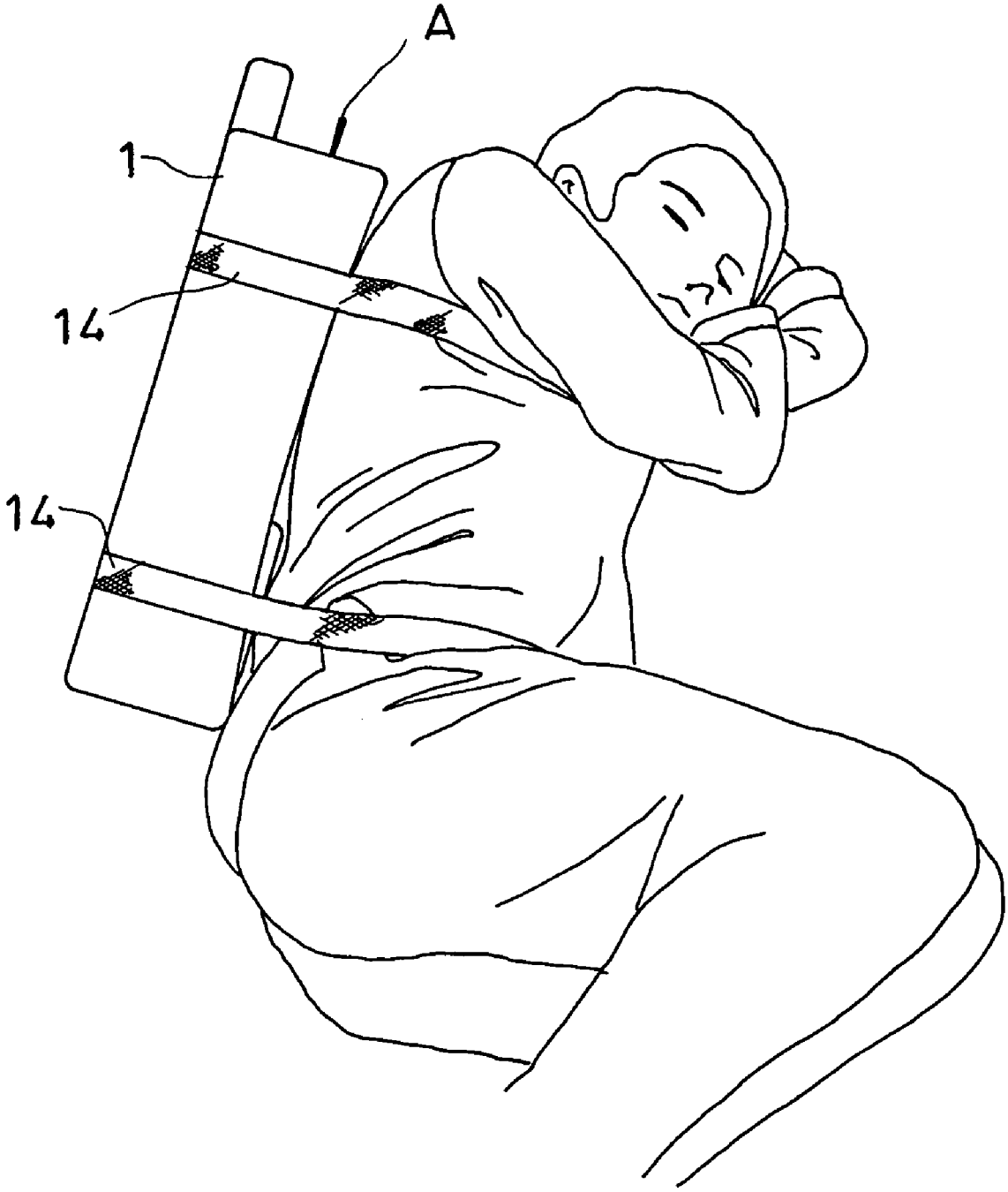
FIG. 5 is a perspective view of the first embodiment of an automatic back patter in the present invention, showing it used in a first way.

The main body 1 is hollow, having a curved surface 11 on an upper wall conforming to the curvature of a human back, a plurality of openings 12 spaced apart equidistantly in the upper wall for the patting heads to be respectively fitted movably therein. The main body 1 further has a grip 13 formed in one end for a hand to hold for carrying the patter, and a Velcro tip (not shown) fixed on the other end for a backpacking band 14 to connect with as shown in FIG. 5.

Next, the power source 2 is a brushless motor, which is adjustable in rotating speed and time, having a shaft 21 connected indirectly to the striking disc 3 via a belt extending around the shaft 21 and a shaft 32 of the striking disc 3.

Figure 3:
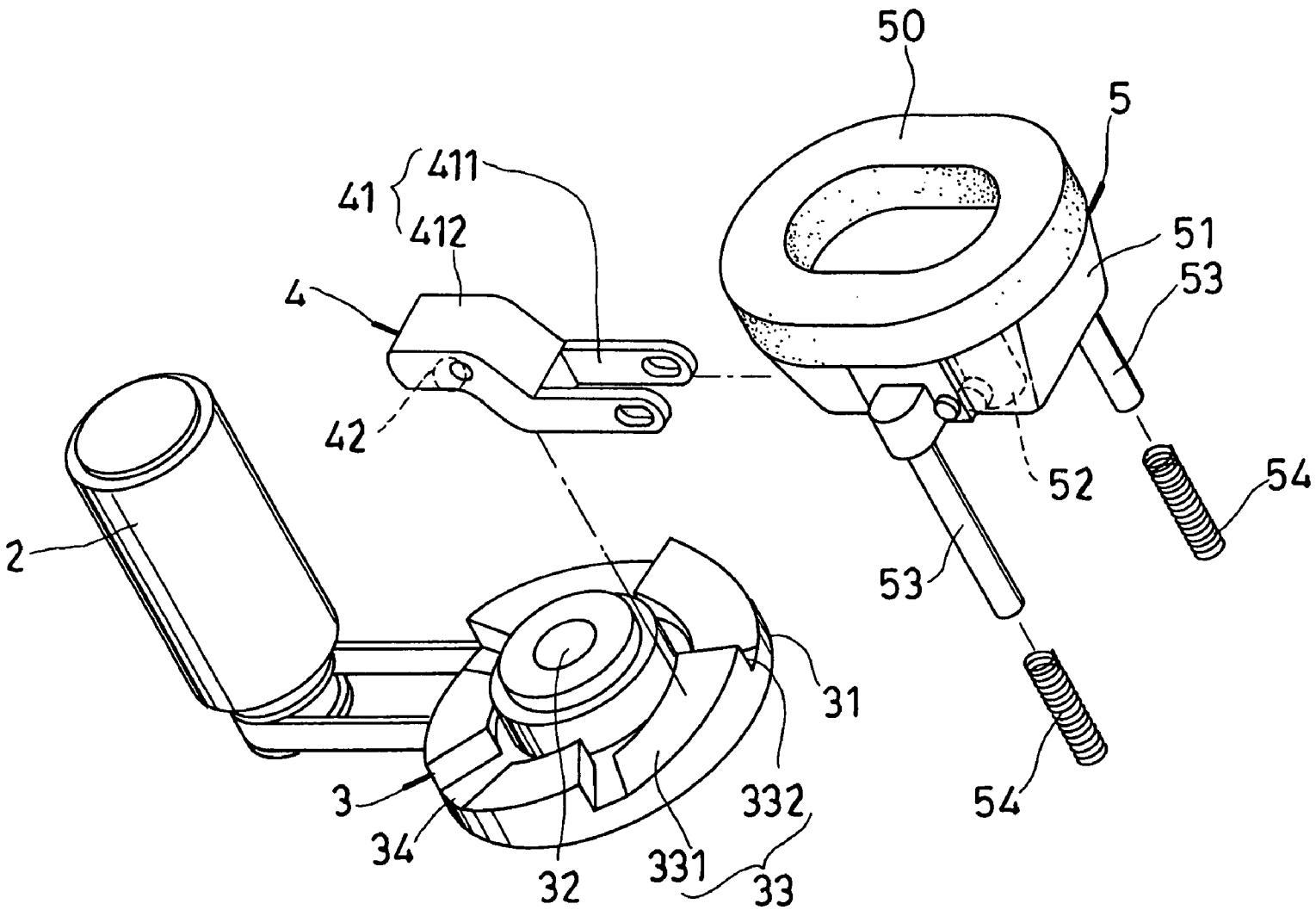
FIG. 3 is a partial exploded perspective view of the first embodiment of an automatic back patter in the present invention.

As shown in FIG. 3, the striking disc 3 is provided with a circular disc 31, a shaft 32 connected to the shaft 21 of the power source 2, a plurality of inclined projections 33 spaced apart equidistantly and respectively provided with a sloped upper surface 331 and a vertical cut side 332 at a high end, so the circular disc 31 has an uneven surface 34 with the inclined projections 33 arranged equidistantly spaced along the outer circumference Each transmitting arm 4 consists of two parallel long thin arms 411 and a short thick arm 412 continuing the two thin arms 411, forming a Z-shaped swing arm 41, and the short arm 412 has an outer end provided with a bead 42, which contacts the upper uneven surface of the striking disc 3 to slide thereon, and one of the two long arms 411 is then connected to a connect rod 52 of the patting head 5, and the connecting section of the long arms 411 with the short arm 412 is pivotally connected to a proper location of the main body 1, functioning as a fulcrum.

Figure 4:
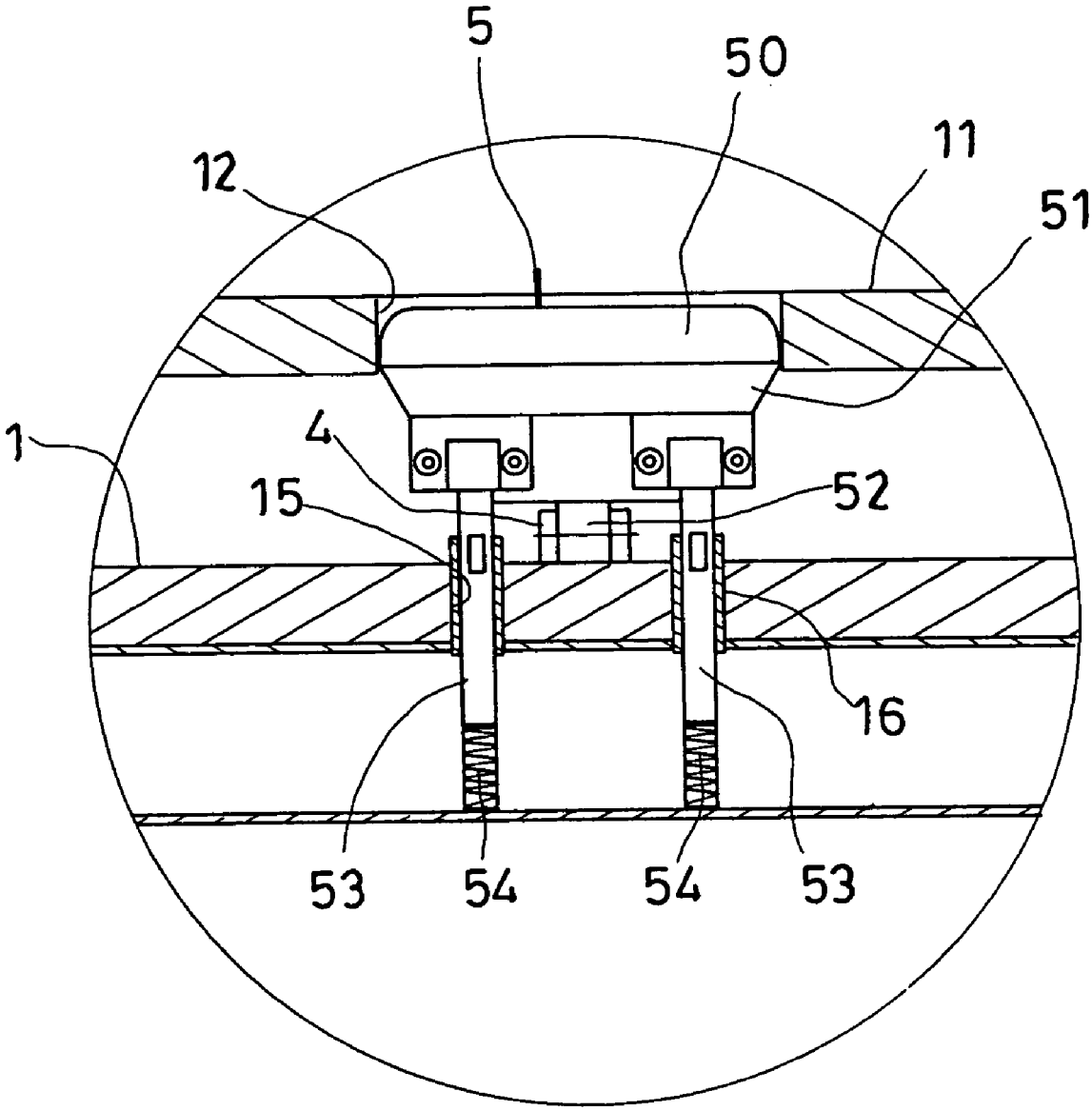
FIG. 4 is partial side cross-sectional view of the first embodiment of an automatic back patter in the present invention.

Next, each patting head 5, as shown in FIG. 4, consists of a patter body 51 with a center hole, a soft cushion 50 made of soft silica foam affixed on the patter body 51, the connect rod 52 extending down to connect with the other end (i.e. the outer end of the two long arms 411) of the transmitting arm 4, and two bars respectively extending down from two sides of the patter body 51 beside the connect rod 52 and having its lower end contacting an upper end of a coiled spring 54 functioning as a pressure spring fitted in a hole 15 in the main body 1, and a straight bearing 16 deposited in the hole 15 and possible to fit around the coiled spring 54.

Lastly, the film 6 is laid on the curved surface 11 with the openings 12 of the main body 1.

Figure 6:
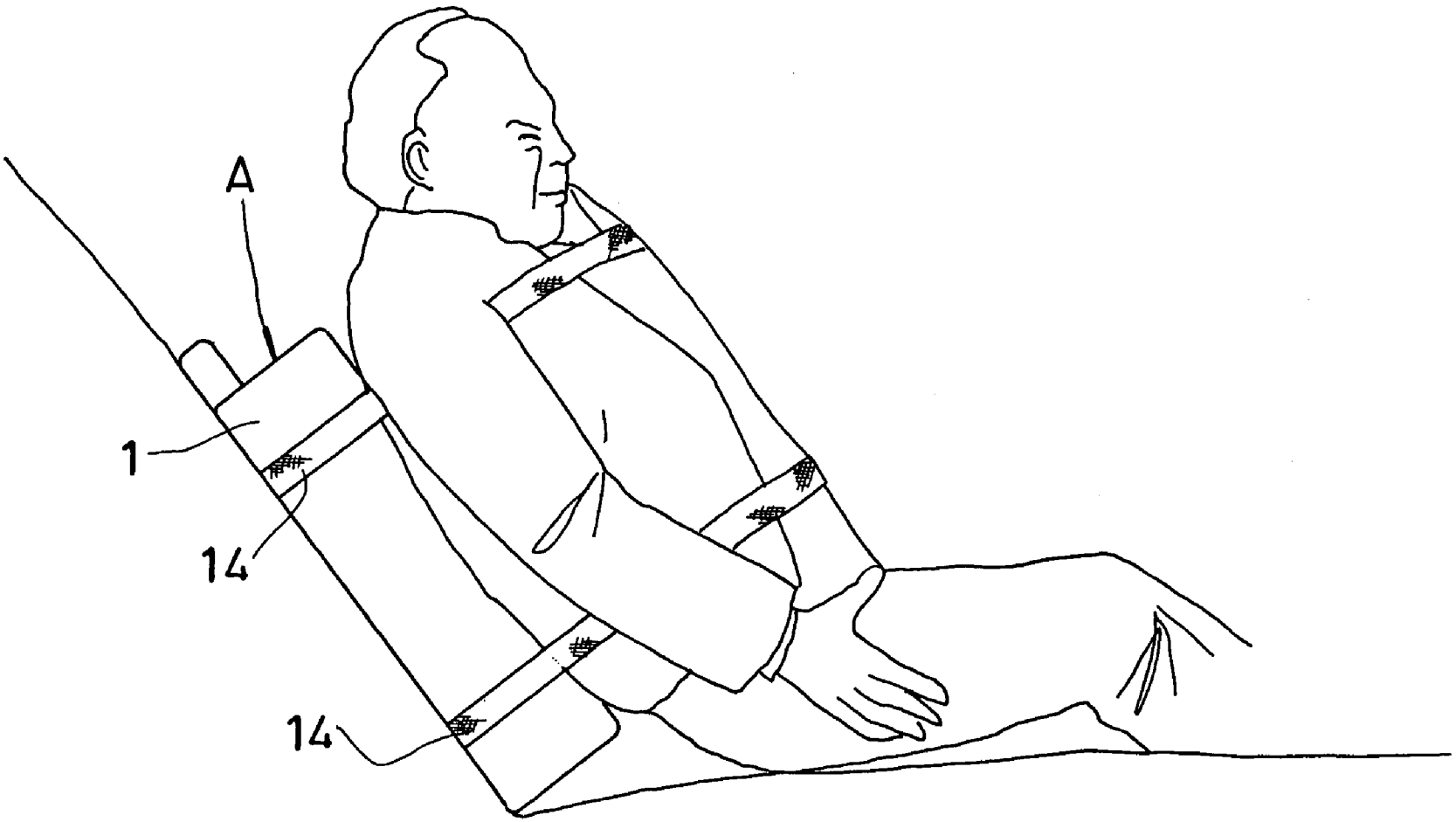
FIG. 6 is a perspective view of the first embodiment of an automatic back patter in the present invention, showing it used in a second way.
Figure 7:
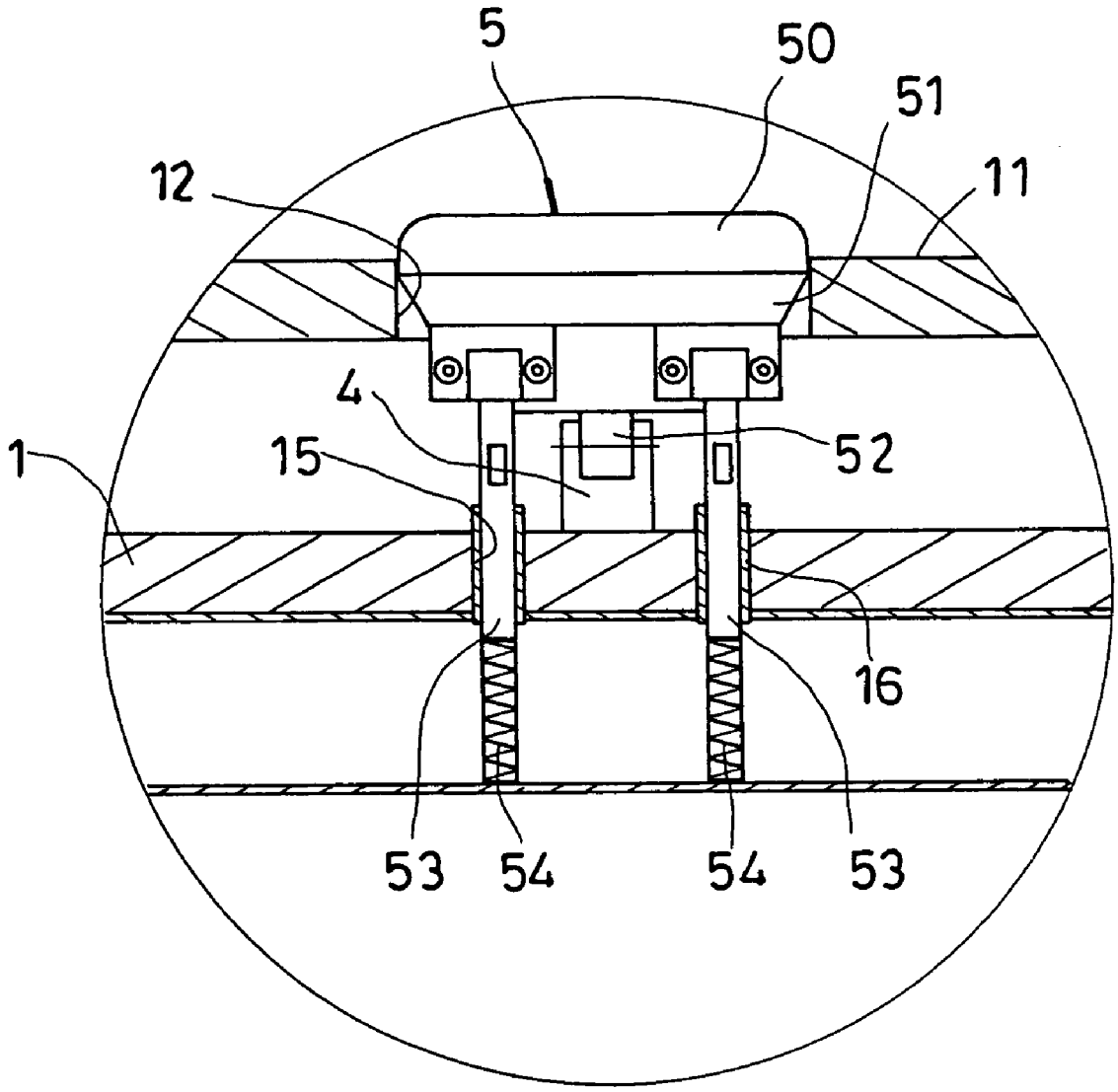
FIG. 7 is a partial cross-sectional view of the first embodiment of an automatic back patter in the present invention, showing the patting head pushed up by the coil springs and protruding out of an opening of a main body.

In using, as shown in FIGS. 5 and 6, the automatic back patter is placed the back and the backpacking band 14 is temporarily connect to the Velcro tip for binding the patter on the back of the user. Then the power source is started to rotate the striking disc 3, referring to FIG. 2, and the end of each transmitting arm 4 contacting the surface 34 of the striking disc 3 may move up gradually along one inclined projection 33 and then drops down the vertical cut side 332 of each projection 33 on the lowest location between every two projections 33 so that each patting head 5 connected to each transmitting arm 4 may be forced to move up and then fall down abruptly. When each patting head 5 falls down, the springs 54 contacting the bars 53 of each patting head 5 is compressed into a shrunk condition, as shown in FIG. 4. Then when each patting head 5 is moved up again by each transmitting arm 4 again, the compressed springs 54 is instantly released, as shown in FIG. 7, quickly pushing up the pattering head 5, which then protrudes out of the opening 12 and pats on the back of the user with certain force that is helpful to invigorate the muscle of the patient (or the user), stimulating blood circulation, preventing bedsores, or dead muscle tissues, from happening, and beneficial for the patient to salivate.

It is important to mention that each transmitting arm 4 connected to each patting head 5 keeps the outer end always at the highest point or the lowest point of the sloped surface 331 of each inclined projection 33 of the striking disc 3. So when the patting heads 5 operate, the positional disparity of the transmitting arms 4 at the highest point and the lowest point of each sloped surface 331 enables each transmitting arm 4 produce alternate up-and-down movement at the same time in case the striking disc 3 rotates. Therefore, all the patting heads 5 alternately pat on the back, upgrading the effect of preventing bedsores.

Moreover, the outer end of the short arm 412 of the transmitting arm 4 contacts the upper surface of the striking disc 3 and the outer end of the long arms 411 are connected to the patting head 5, so the striking disc 3 rotates to bring the outer end of the short arm 412 to swing up and down, permitting the outer end of the long arms 411 to swing up and down largely and accordingly the patter heads 5 also move up and down, intensifying the effect of patting.

In addition, a user can adjust the working speed and time of the power source 2 so as to control the patting speed and time of the patting heads 5, thus the time needed for patting a patient can be selected.

Besides, the grip 13 formed on the main body 1 can be used for carrying about the automatic back patter (A).

Figure 8:
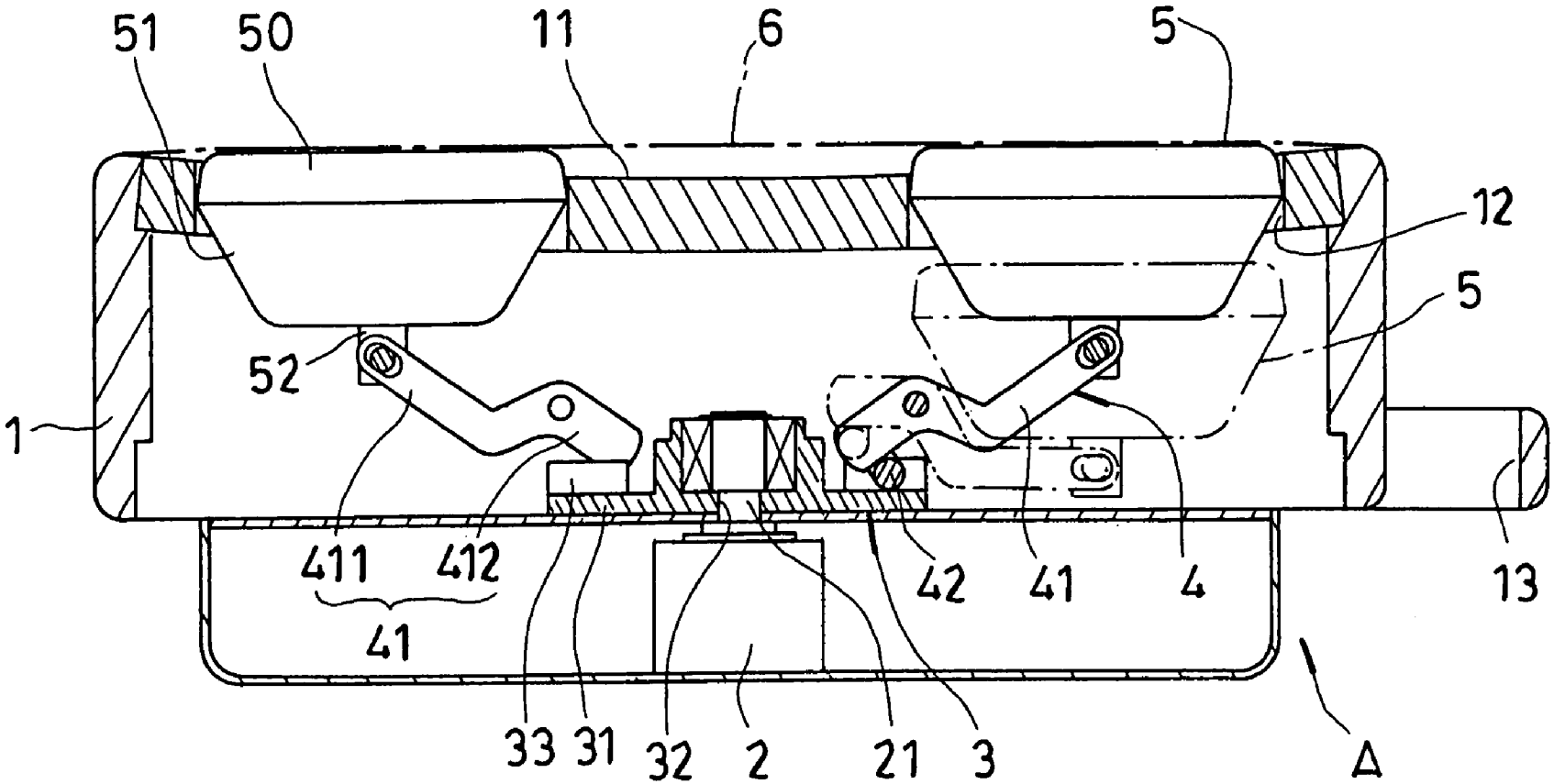
FIG. 8 is a side cross-sectional view of a second embodiment of an automatic back patter in the present invention; and, FIG. 9 is a perspective view of a conventional manual patting way.
Figure 9:
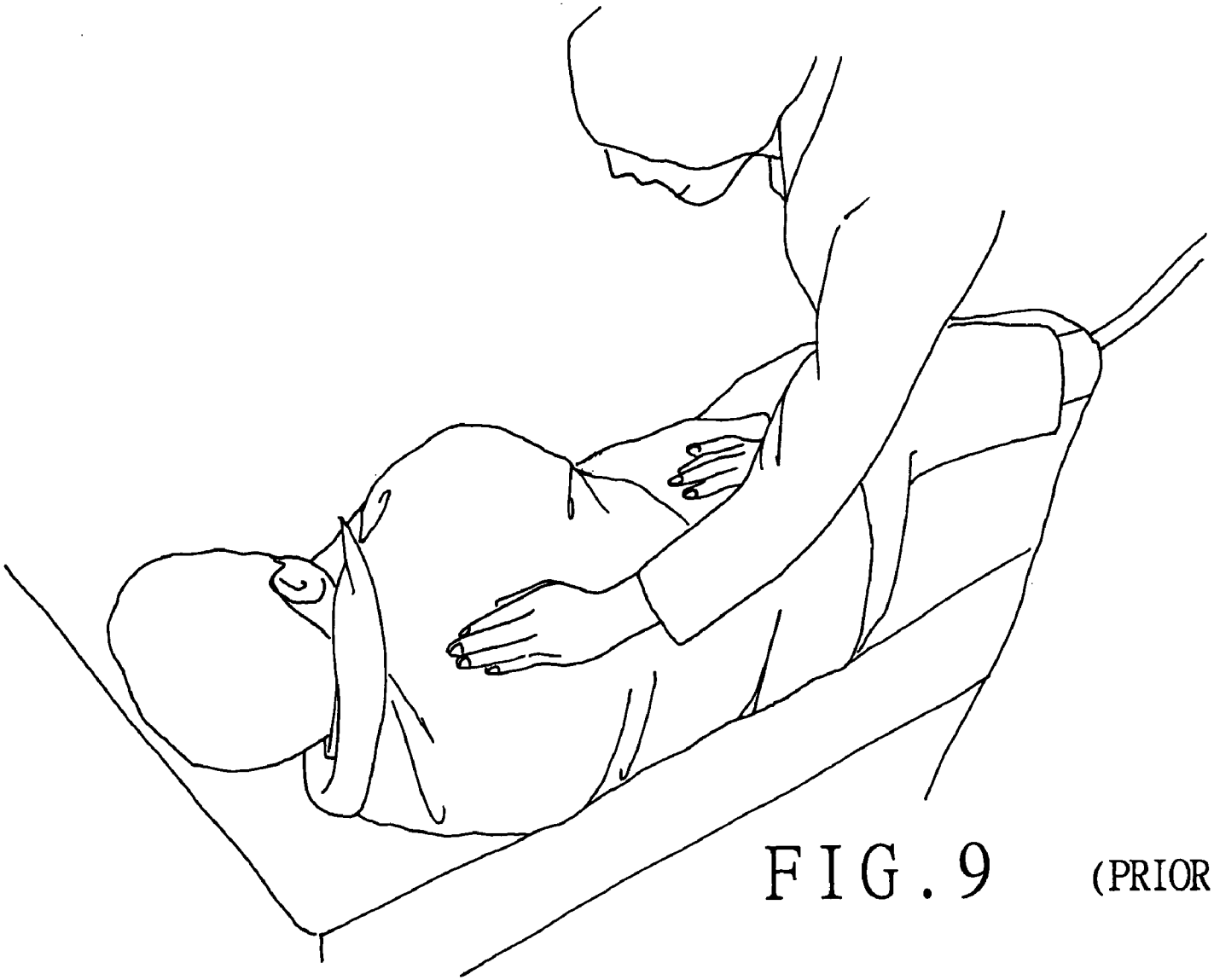
FIG. 9 (PRIOR ART)

Next, FIG. 8 shows a second embodiment of an automatic back patter in the invention, having almost the same structure as the first one, except that the shaft 21 of the power source 2 is directly connected to the shaft 32 of the striking disc 3, saving the belt in the first embodiment.

The invention has the following advantages, as can be understood from the foresaid description.

1. All the patting heads can alternately be moved up and down to produce alternate patting action to a patient, because one end of the transmitting arms is always located alternately different at the highest point and at the lowest point, and thus this kind of augmented patting can help invigorate the muscle of the patient bedridden for long, stimulating blood circulation of the body surface, and preventing the bedsores caused by dead muscle tissues from happening.
2. Provision of the coiled springs in conjunction with the up-and-down movement of the transmitting arms and the patting heads assists to increase the patting force of the patting heads, thus beefing up invigoration of the muscle and stimulation of the blood circulation of the body surface.
3. The patting time and speed of the patting heads is adjustable according to need of a user, or a patient bedridden for long can get patting at regular times, for stimulating blood circulation of the body surface, and preventing the muscle tissues from getting dead.
4. The curved surface of the automatic back patter can closely contact the body surface of a patient so as to heighten the patting effect.
5. The soft cushion made of silicon foam added on the surface of the pattering heads can let a user feel comfortable.
6. The grip is convenient for carrying about the automatic back patter.
7. The backpacking bands are beneficial for binding the automatic back patter on the back of a patient, by releasably connecting with the Velcro tips of the main body, convenient for taking off and washing.

While the preferred embodiments of the invention have been described above, it will be understood that various modifications may be made therein and the appended claims are intended to cover all such modifications that may fall within the spirit and scope of the invention.

What is claimed is:

1. An automatic back patter comprising:

a main body having an upper flat wall bored at least an opening;

a power source installed in said main body;

a striking disc installed in said main body and connected to be rotated by said power source, said striking disc provided with an uneven surface;

at least one transmitting arm installed inside said main body and respectively having one end contacting said uneven surface of said striking disc and the other end connected to a patting head and an intermediate portion pivotally connected to said main body; and, at least one said patting head connected to said transmitting arm, said patting head fitted in said opening in said main body.

2. The automatic back patter as claimed in claim 1, wherein said main body has a grip formed in one end.

3. The automatic back patter as claimed in claim 1, wherein said main body has a backpacking band attached on one side.

4. The automatic back patter as claimed in claim 3, wherein said main body and said backpacking band are connected by means of a hook and loop fastener tip.

5. The automatic back patter as claimed in claim 1, wherein said power source is a brushless motor.

6. The automatic back patter as claimed in claim 1, wherein said striking disc has a circular body, and said uneven surface is provided with a plurality of inclined projections spaced apart equidistantly around an outer circumference, each said inclined projection having a sloped upper surface and a vertical cut side formed at its highest end so as to form said uneven surface.

7. The automatic back patter as claimed in claim 1, wherein said transmitting arm is provided with a bead in an outer end for contacting said uneven surface of said striking disc.

8. The automatic back patter as claimed in claim 1, wherein said transmitting arm is composed of two parallel long thin arms and a short thick arm continuing from said two parallel long arms, said two long arms and said short arm forming a nearly Z shape, an outer end of said short thick arm always contacts said uneven surface of said striking disc, and an outer end of said two parallel long arms is connected with said patting head.

9. The automatic back patter as claimed in claim 1, wherein said patting head has a connect rod extending down from its bottom, said connect rod is connected to said transmitting arm, and two bars in parallel are fixed at two opposite sides of said patting head, extending down to fit in two holes of said main body and contacting an upper end of two coiled springs fitted in said two holes.

10. The automatic back patter as claimed in claim 9, wherein said coiled springs are compress springs.

11. The automatic back patter as claimed in claim 9, wherein a bearing is fitted in said two holes of said main body respectively for each said bar to move in and out.

12. The automatic back patter as claimed in claim 11, wherein said bearings are linear bearings.

13. The automatic back patter as claimed in claim 1, wherein an upper surface of said upper wall of said main body is curved in the same way as a human back is.

14. The automatic back patter as claimed in claim 13, wherein a film is covered on said upper surface of said main body.

15. The automatic back patter as claimed in claim 1, a soft cushion is mounted on an upper surface of a body of said patting head.

16. The automatic back patter as claimed in claim 15, wherein said soft cushion is made of silica foam.

17. The automatic back patter as claim as claim 15, wherein said body of said patting head is hollow.

18. The automatic back patter as claimed as claim 1, wherein a plurality of said transmitting arms respectively have one end contacting said uneven upper surface of said striking disc, a plurality of said patting heads are connected to the other end of said transmitting arms respectively, and said main body is provided with a plurality of said openings for said plural patting heads to fit therein, respectively.

* * * * *